US008978599B2

(12) United States Patent
Shioura

(10) Patent No.: US 8,978,599 B2
(45) Date of Patent: Mar. 17, 2015

(54) COOLING APPARATUS OF INTERNAL COMBUSTION ENGINE FOR VEHICLE

(71) Applicant: Suzuki Motor Corporation, Shizuoka-ken (JP)

(72) Inventor: Yuichiro Shioura, Shizuoka-Ken (JP)

(73) Assignee: Suzuki Motor Corporation (JP)

( * ) Notice: Subject to any disclaimer, the term of this patent is extended or adjusted under 35 U.S.C. 154(b) by 61 days.

(21) Appl. No.: 13/790,969

(22) Filed: Mar. 8, 2013

(65) Prior Publication Data

US 2013/0239912 A1 Sep. 19, 2013

(30) Foreign Application Priority Data

Mar. 9, 2012 (JP) ..... 2012-052734

(51) Int. Cl.
*F01P 3/00* (2006.01)
*F01P 7/16* (2006.01)

(52) U.S. Cl.
CPC . *F01P 3/00* (2013.01); *F01P 7/165* (2013.01); *F01P 2037/02* (2013.01)
USPC ..... 123/41.44; 123/41.04; 123/41.02

(58) Field of Classification Search
CPC ..... F01P 3/00; F01P 7/165; F01P 7/16; F01P 7/00; F01P 7/14; F01P 7/167
USPC ..... 123/41.02, 41.44
See application file for complete search history.

(56) References Cited

U.S. PATENT DOCUMENTS 6,539,899 B1 * 4/2003 Piccirilli et al. ..... 123/41.1
2008/0115747 A1 * 5/2008 Snyder et al. ..... 123/41.31

FOREIGN PATENT DOCUMENTS

DE 10351852 A1 6/2005
DE 102004008170 A1 9/2005
EP 1529937 B1 1/2012
JP 2011-220156 A 11/2011
JP 2007-522388 * 7/2012 ..... C04B 35/14
WO 2005080766 A1 9/2005

OTHER PUBLICATIONS

German Office Action for Application No. 102013204056 dated Aug. 27, 2013.

* cited by examiner

*Primary Examiner* — Lindsay Low
*Assistant Examiner* — Kevin Lathers
(74) *Attorney, Agent, or Firm* — Lerner, David, Littenberg, Krumholz & Mentlik, LLP

(57) ABSTRACT

A control device includes target temperature setting means, feedback control means, and shortcut control means. The target temperature setting means sets a target temperature (γ) of a coolant according to a temperature state of an internal combustion engine. The feedback control means controls a control valve in such a manner that a coolant temperature is the target temperature (γ). The shortcut control means controls the control valve in such a manner that, when the internal combustion engine is in a cold state, the target temperature setting means sets as the target temperature (γ) a warming-up temperature (α) higher than a feedback control temperature (A or B) which is set during feedback control.

4 Claims, 11 Drawing Sheets

CONTROL VALVE STATE IN EXECUTING SHORTCUT CONTROL

CONTROL VALVE STATE IN EXECUTING AUXILIARY-MACHINERY WARMING-UP CONTROL

CONTROL VALVE STATE IN EXECUTING COOLING CONTROL

| OUTSIDE-AIR TEMPERATURE | KNOCKING PRESENT (FIRST SET VALUE C) | KNOCKING ABSENT (SECOND SET VALUE D) |
|---|---|---|
| PROPORTION VALUE | 0.8 | 0.5 |

C < D

| OUTSIDE-AIR TEMPERATURE | KNOCKING PRESENT (FIRST SET VALUE C) | KNOCKING ABSENT (SECOND SET VALUE D) |
|---|---|---|
| PROPORTION VALUE | 0.8 | 0.5 |

$C < D$

COOLING APPARATUS OF INTERNAL COMBUSTION ENGINE FOR VEHICLE

CROSS-REFERENCE OF RELATED APPLICATION

The present application claims priority from Japanese Patent Application No. 2012-052734 filed Mar. 9, 2012, the disclosure of which is hereby incorporated herein by reference.

TECHNICAL FIELD

The present invention relates to a cooling apparatus of an internal combustion engine for a vehicle and more particularly relates to a cooling apparatus of an internal combustion engine for a vehicle which is capable of appropriately maintaining the temperature of the internal combustion engine by controlling a coolant passage of a coolant (cooling water) for the internal combustion engine.

BACKGROUND ART

Cooling apparatuses of an internal combustion engine mounted on a vehicle include a cooling device configured to control a coolant passage by using an electrically controlled control valve which is arranged instead of a thermostat in the coolant passage for a flow of a coolant (cooling water), so that fuel efficiency is improved by acceleration of coolant temperature rise.

Coolant temperature control using the control valve is performed in the following manner. Specifically, when the internal combustion engine is in a cold state, a coolant temperature is raised to a high temperature (110° C., for example) as quickly as possible. When the coolant temperature reaches the high temperature, the control valve is immediately controlled so that the temperature of the coolant is at a slightly lower temperature (90° C., for example) to avoid knocking.

Meanwhile, conventional cooling apparatuses include a cooling device having a minimum circulation path in addition to the coolant passage. When the internal combustion engine is started to be warmed up, all the control valves (selector valves) are closed to cause the coolant to flow through the minimum circulation path. Thereby, the internal combustion engine is warmed up quickly.

In a control device of a cooling system according to JP 2011-220156 A ("Patent Document 1"), a radiator configured to cool a coolant (cooling water) in an internal combustion engine, a heat exchanger for air conditioning, and an accessory of the internal combustion engine (a throttle body) are provided with coolant passages, respectively, and are connected to the internal combustion engine. These coolant passages are provided with control valves (selector valves), which are opened sequentially according to the coolant temperature. Specifically, when the coolant temperature reaches a predetermined set temperature, it is determined that the internal combustion engine is in the warmed-up state. The coolant passage for the radiator, the coolant passage for the heat exchanger for air conditioning, and the coolant passage for the accessory of the internal combustion engine are opened in this order.

SUMMARY OF THE INVENTION

Problems to be Solved by the Invention

In improving the fuel efficiency in the cooling apparatus of the internal combustion engine, it is important to reduce engine friction by accelerating temperature rise of hydraulic oil for the internal combustion engine, by use of the temperature rise of the coolant temperature. Before the hydraulic oil is in the warmed-up state, the coolant temperature is controlled to be maintained at a temperature, for example, 90° C. slightly lower than a target temperature to reliably avoid occurrence of knocking. However, the controlling of the control valve based only on the coolant temperature does not lead to thorough improvement of the fuel efficiency of the internal combustion engine in the cold state. Meanwhile, as described in Patent Document 1, it is preferable that the temperatures of the accessory of the internal combustion engine and the heat exchanger for air conditioning, which are vehicle accessories, be always maintained at appropriate temperatures. For example, when the accessory of the internal combustion engine is a throttle body, maintaining the temperature thereof constant makes it possible to stabilize an oxygen content of air passing through the throttle body and to maintain the heat exchanger for air conditioning in a heating-ready state. In other words, when in the cold state, the accessory of the internal combustion engine and the heat exchanger for air conditioning are preferably warmed up as soon as possible and maintained in a favorable condition.

Furthermore, although warming up the accessory of the internal combustion engine and the heat exchanger for air conditioning, a control device in Patent Document 1 has room for improvement in a point of early warming-up.

Hence, an object of the present invention is to provide a cooling apparatus of the internal combustion engine for a vehicle which is capable of quickly warming up an internal combustion engine and a vehicle accessory.

Means for Solving the Problems

The present invention is a cooling apparatus of an internal combustion engine for a vehicle, comprising: a coolant cooling device for cooling a coolant used for cooling the internal combustion engine; a control device for controlling a coolant passage according to a temperature state of the internal combustion engine; a first coolant passage which allows the coolant discharged from the internal combustion engine to flow in a circulated manner into the internal combustion engine via the coolant cooling device; a second coolant passage which allows the coolant discharged from the internal combustion engine to flow in a circulated manner into the internal combustion engine via a vehicle accessory; a third coolant passage which allows the coolant discharged from the internal combustion engine to flow in the circulated manner into the internal combustion engine, the third coolant passage having a cooling capacity lower than those of the first coolant passage and the second coolant passage; and at least one control valve by which coolant flow rates of the first coolant passage, the second coolant passage, and the third coolant passage are changed, wherein the control device includes: target temperature setting means for setting a target temperature of the coolant according to the temperature state of the internal combustion engine; feedback control means for controlling the control valve in such a manner that a temperature of the coolant is the target temperature; and shortcut control means for controlling the control valve in such a manner that, when the internal combustion engine is in a cold state, the target temperature setting means sets as the target temperature a warming-up temperature higher than a feedback control temperature which is set during feedback control, and the shortcut control means controls the control valve in such a manner as to keep the coolant flow rate of the third coolant passage higher than the coolant flow rates of the first coolant passage and the second coolant passage until the temperature of the coolant reaches the warming-up temperature.

Effects of the Invention

The present invention makes it possible to quickly warm up an internal combustion engine and an accessory for a vehicle.

MODE FOR CARRYING OUT THE INVENTION

An object of the present invention is to quickly warm up an internal combustion engine and a vehicle accessory. The present invention achieves the object in such a manner that a flow rate of a coolant in a third coolant passage having a low cooling capacity is increased when the internal combustion engine is in a cold state and thereby the coolant is maintained in a high-temperature state.

Embodiment

FIGS. 1 to 15 show an embodiment of the present invention.

Figure 1:
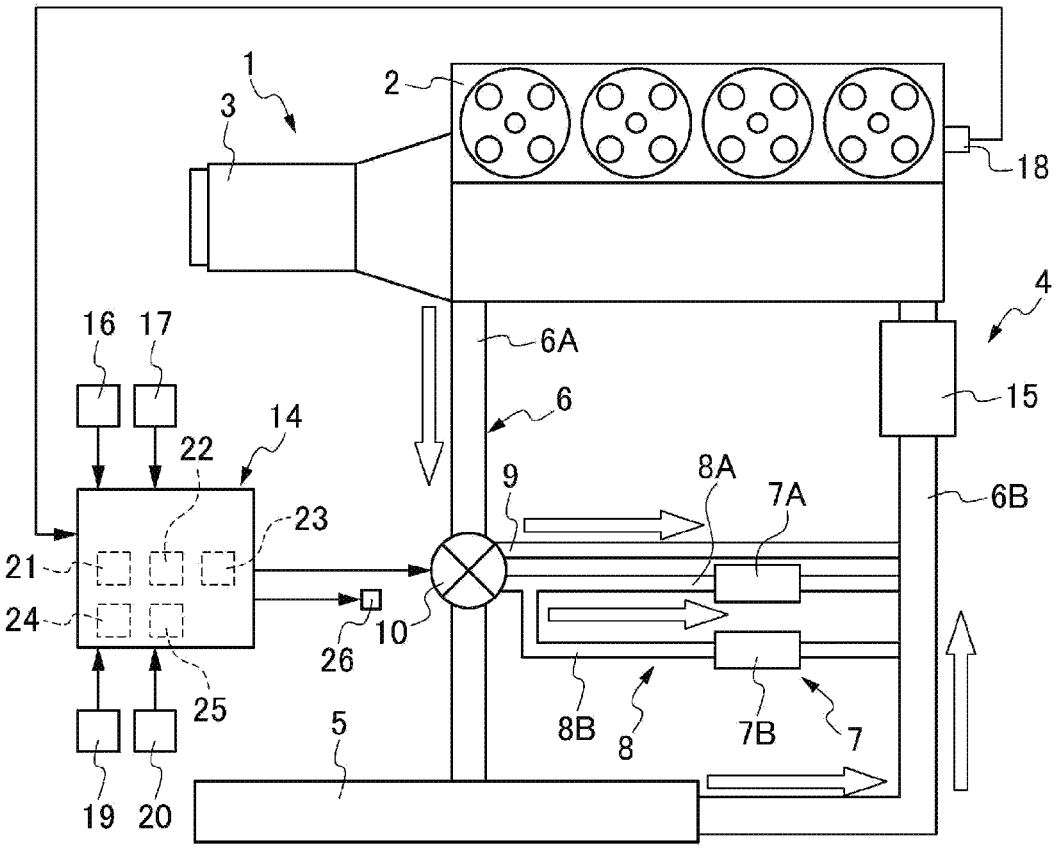
FIG. 1 is a system configuration diagram of a cooling apparatus of an internal combustion engine. (Embodiment)

In FIG. 1, reference numeral 1 denotes a power unit mounted on a vehicle.

The power unit 1 integrally includes: an internal combustion engine 2 used for driving the vehicle and serving as a power source; and a transmission 3 coupled to the internal combustion engine 2.

The internal combustion engine 2 is provided with a cooling apparatus 4. The cooling apparatus 4 includes a coolant cooling device (a radiator) 5 configured to cool a coolant (cooling water) used for cooling the internal combustion engine 2.

The cooling apparatus 4 is also provided with a first coolant passage 6 which allows the coolant discharged from the internal combustion engine 2 to flow in a circulated manner into the internal combustion engine 2 via the coolant cooling device 5. The first coolant passage 6 has one end connected to one lateral portion of the internal combustion engine 2 and the other end connected to the other lateral portion of the internal combustion engine 2. The first coolant passage 6 is divided into a first inlet-side coolant passage 6A and a first outlet-side coolant passage 6B while the coolant cooling device 5 is located therebetween in the course of the first coolant passage 6. The first inlet-side coolant passage 6A extends from the internal combustion engine 2 to the coolant cooling device 5, and the first outlet-side coolant passage 6B extends from the coolant cooling device 5 to the internal combustion engine 2.

A second coolant passage 8 is provided between the first inlet-side coolant passage 6A and the first outlet-side coolant passage 6B in such a manner that the coolant discharged from the internal combustion engine 2 takes a shortcut without passing through the coolant cooling device 5 to flow in the circulated manner into the internal combustion engine 2 via a first vehicle accessory (a heat exchanger for air conditioning or a throttle body) 7A included in a vehicle accessory 7. The second coolant passage 8 includes a second main coolant passage 8A and a second branch coolant passage 8B which branches from the second main coolant passage 8A and is connected to the first outlet-side coolant passage 6B. On the second branch coolant passage 8B, a second vehicle accessory 7B included in the vehicle accessory 7 is arranged.

In addition, a third coolant passage 9 having a lower cooling capacity than those of the first coolant passage 6 and the second coolant passage 8 is provided between the first inlet-side coolant passage 6A and the first outlet-side coolant passage 6B and in parallel with the second coolant passage 8 in such a manner that the coolant discharged from the internal combustion engine 2 takes a shortcut without passing through the coolant cooling device 5 to flow into the internal combustion engine 2 in the circulated manner.

Furthermore, a control valve 10 is arranged in the course of the first inlet-side coolant passage 6A. The control valve 10 is parallel-connected to one of the ends of the second coolant passage 8 and the third coolant passage 9, respectively. The control valve 10 controls a portion of the first inlet-side coolant passage 6A which is downstream of the control valve 10, the second coolant passage 8, and the third coolant passage 9, so that flow rates of the coolant flowing through the first inlet-side coolant passage 6A, the second coolant passage 8, and the third coolant passage 9 are changed. The other ends of the second main coolant passage 8A, the second branch coolant passage 8B, and the third coolant passage 9, respectively, are parallel-connected to the first outlet-side coolant passage 6B.

Figure 2A:
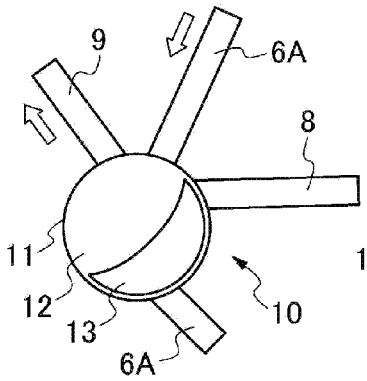
FIG. 2A is a diagram showing an operating state of a control valve during shortcut control.
Figure 2B:
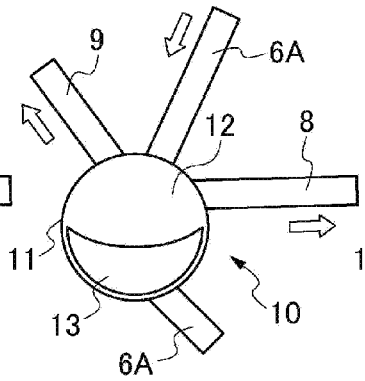
FIG. 2B is a diagram showing an operating state of the control valve during accessory warming-up control.
Figure 2C:
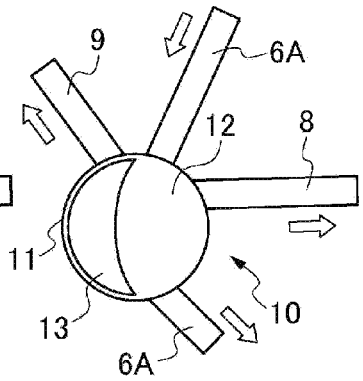
FIG. 2C is a diagram showing an operating state of the control valve during cooling control. (Embodiment)

The control valve 10 which is a three-way selector valve controlled electronically includes a case 11 and a valve element 13 having a crescent-shaped cross section which rotatably operates in an internal space 12 in the case 11, as shown in FIG. 2. The control valve 10 causes the internal space 12 to communicate with the one ends of the first inlet-side coolant passage 6A, the second coolant passage 8, and the third coolant passage 9 in a switching manner by using a rotating operation of the valve element 13. The control valve 10 is operated in any of the states in which shortcut control (FIG. 2A) is executed, accessory warming-up control (FIG. 2B) is executed, and cooling control (FIG. 2C) is executed.

The control valve 10 is connected with a control device 14 and electronically controlled by the control device 14.

A water pump 15 is provided to the first outlet-side coolant passage 6B in a portion closer to the internal combustion engine 2 than portions thereof connected to the other ends of the second main coolant passage 8A, the second branch coolant passage 8B, and the third coolant passage 9.

The control device 14 is connected with: a power supply 16 configured to supply power; an ignition switch 17 configured to turn on/off the internal combustion engine 2; a knocking sensor configured to detect abnormal combustion in the internal combustion engine 2; a coolant temperature sensor 19 configured to detect a temperature (Tw) of the coolant (the cooling water) in the internal combustion engine 2; and an outside-air temperature sensor 20 configured to detect the outside-air temperature.

The knocking sensor 18 includes piezoelectric elements provided to the internal combustion engine 2. The knocking sensor 18 detects vibration of the internal combustion engine 2 in predetermined cycles, and generates an electrical current therein upon reception of the vibration of the internal combustion engine 2.

The control device 14 controls coolant flow rates in the respective coolant passages 6, 8, and 9 according to the temperature state of the internal combustion engine 2.

In this respect, the control device 14 includes target temperature setting means 21, feedback control means 22, shortcut control means 23, accessory warming-up control means 24, and cooling control means 25. In other embodiments, the target temperature setting means 21, feedback control means 22, shortcut control means 23, accessory warming-up control means 24, and cooling control means 25 comprise individual or combined electronic control units (e.g. computer chip, PLC controller, microchip, etc.) containing the programs, memory, and structure to perform their respective functions.

The target temperature setting means 21 sets a target temperature (γ) of the coolant according to the temperature state of the internal combustion engine 2.

Figure 14:
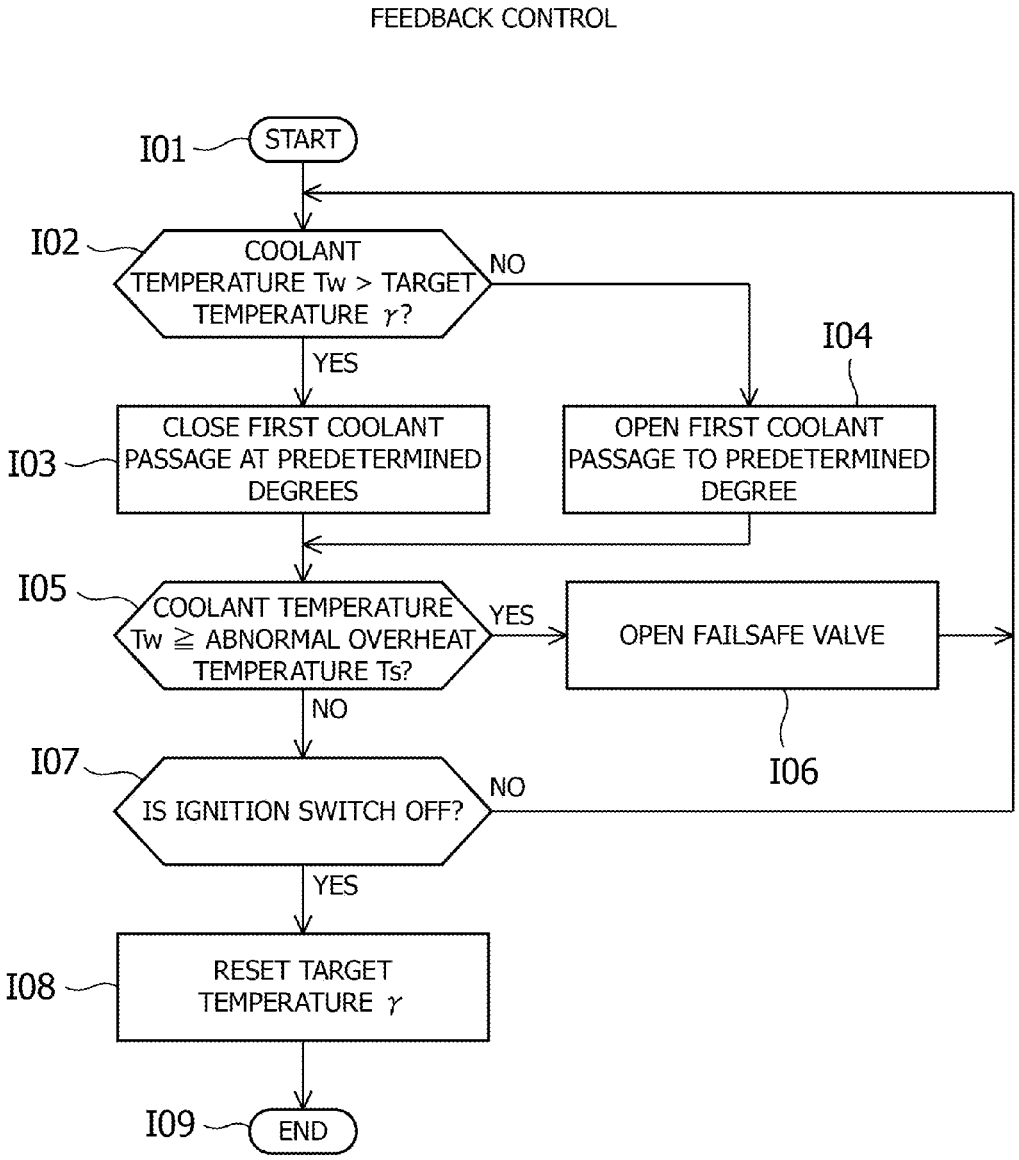
FIG. 14 is a flowchart of feedback control. (Embodiment)

The feedback control means 22 controls the control valve 10 in such a manner that the temperature of the coolant is the target temperature (γ) (see FIG. 14). A failsafe valve 26 provided to the control valve 10 is connected with the feedback control means 22.

The shortcut control means 23 controls the control valve 10 (see FIG. 2A, FIG. 4, and FIG. 15) in such a manner that, when the internal combustion engine 2 is in a cold state, the target temperature setting means 21 sets as the target temperature (γ) a warming-up temperature (α) higher than a feedback control temperature (a first feedback control temperature A or a second feedback control temperature B) which is set during feedback control, and the shortcut control means controls the control valve in such a manner as to keep the coolant flow rate of the third coolant passage 9 higher than the coolant flow rates of the first coolant passage 6 and the second coolant passage 8 until the temperature of the coolant reaches the warming-up temperature (α). The first feedback control temperature A and the second feedback control temperature B have a relation of A<B.

Figure 5:
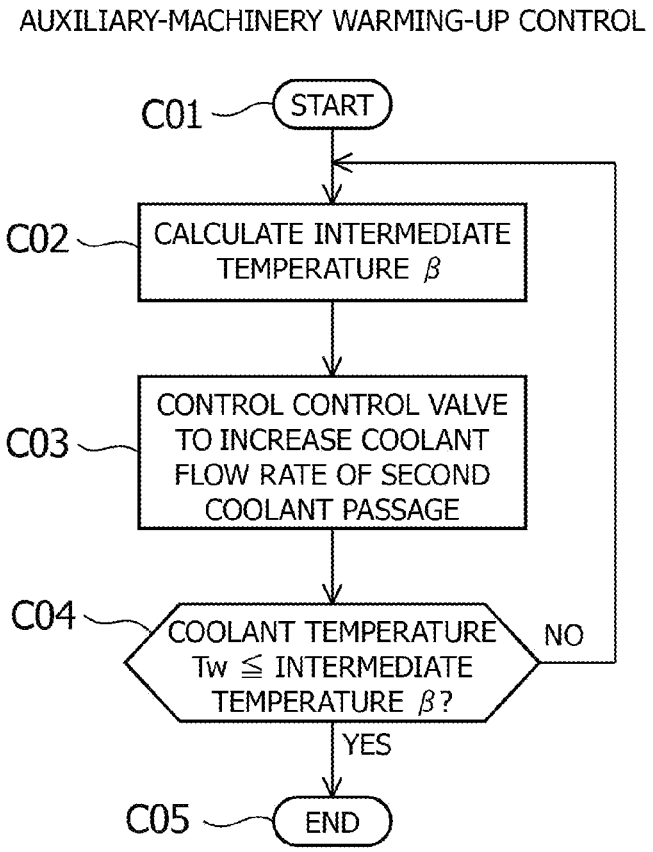
FIG. 5 is a flowchart of the accessory warming-up control. (Embodiment)

When the internal combustion engine 2 is in the warmed-up state, the accessory warming-up control means 24 increases the coolant flow rate of the second coolant passage 8 to warm up the vehicle accessory 7 (see FIG. 5).

The accessory warming-up control means 24 controls the control valve 10 in such a manner that the third coolant passage 9 is maintained opened (see FIG. 2B).

Furthermore, the accessory warming-up control means 24 prohibits the cooling control until the coolant temperature (Tw) reaches an intermediate temperature (β) set at a temperature between the warming-up temperature (α) and the feedback control temperature (A or B) (see FIG. 5).

Figure 9:
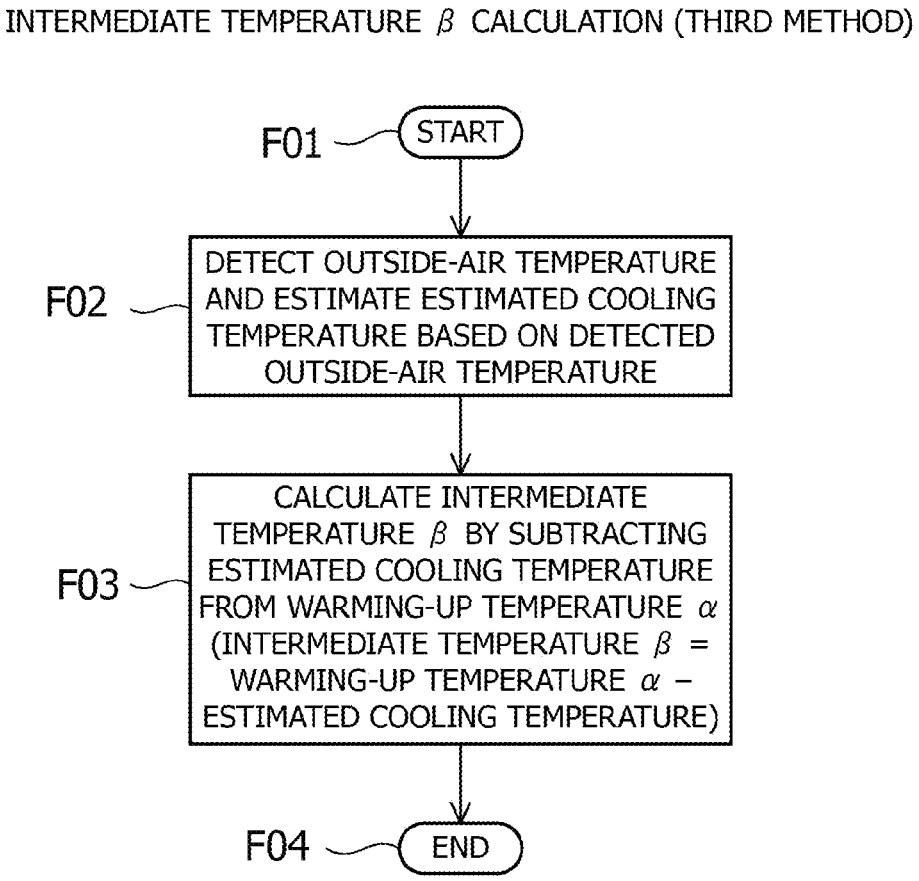
FIG. 9 is a flowchart of a third method for calculating the intermediate temperature (β) (Embodiment)
Figure 10:
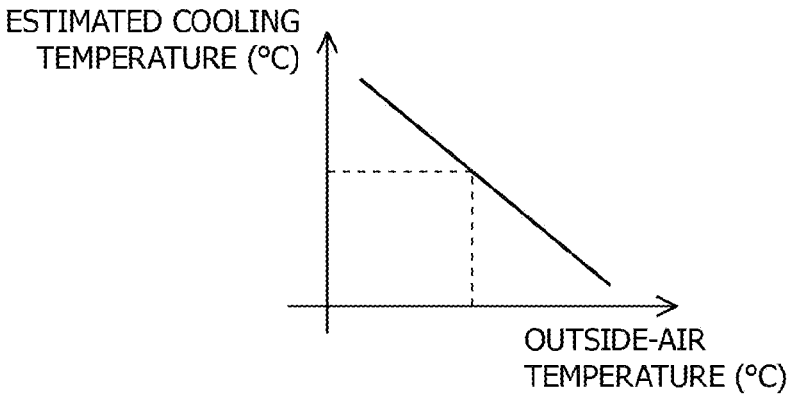
FIG. 10 is a diagram for deciding an estimated cooling temperature relative to the outside-air temperature in the calculation of the intermediate temperature (β) shown in FIG. 9. (Embodiment)

Still further, the accessory warming-up control means 24 calculates the intermediate temperature (β) by subtracting an estimated cooling temperature estimated based on an outside-air temperature from the warming-up temperature (α) (see FIGS. 9 and 10).

In addition, when the knocking sensor 18 detects abnormal combustion, the accessory warming-up control means 24 sets the intermediate temperature (β) at a temperature higher than in a case in which the knocking sensor 18 does not detect abnormal combustion (see FIGS. 7, 8, 11, and 12).

Figures 12, 13:
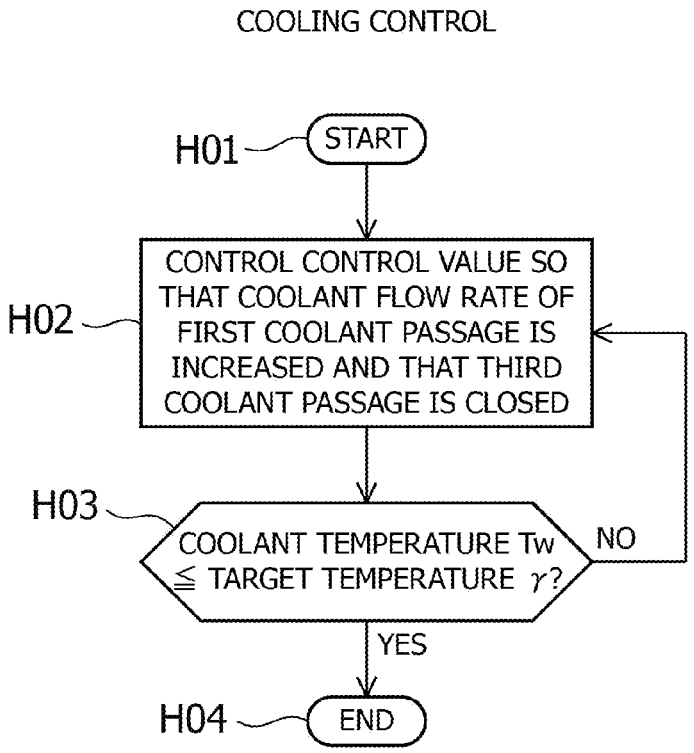
FIG. 12 is a table for explaining outside-air temperatures and proportion values in the calculation of the intermediate temperature (β) shown in FIG. 11. (Embodiment)
FIG. 13 is a flowchart of the cooling control. (Embodiment)

When the vehicle accessory 7 is warmed up, the cooling control means 25 increases the coolant flow rate of the first coolant passage 6 to cool the coolant (see FIG. 13).

When the vehicle accessory 7 is in the warmed-up state, the cooling control means 25 controls the control valve 10 in such a manner that at least one of the coolant passages different from the first coolant passage 6 is maintained opened and that the coolant flow rate of the first coolant passage 6 is increased (see FIG. 2C). In this case, the different coolant passage is the second coolant passage 8.

Furthermore, when the vehicle accessory 7 is in the warmed-up state, the cooling control means 25 controls the control valve 10 in such a manner that at least one of the coolant passages except the different coolant passage maintained opened is closed (see FIG. 2C). In this case, the coolant passage except the different coolant passage is the third coolant passage 9.

A description is given of changes of the aforementioned coolant temperature (Tw).

Figure 15:
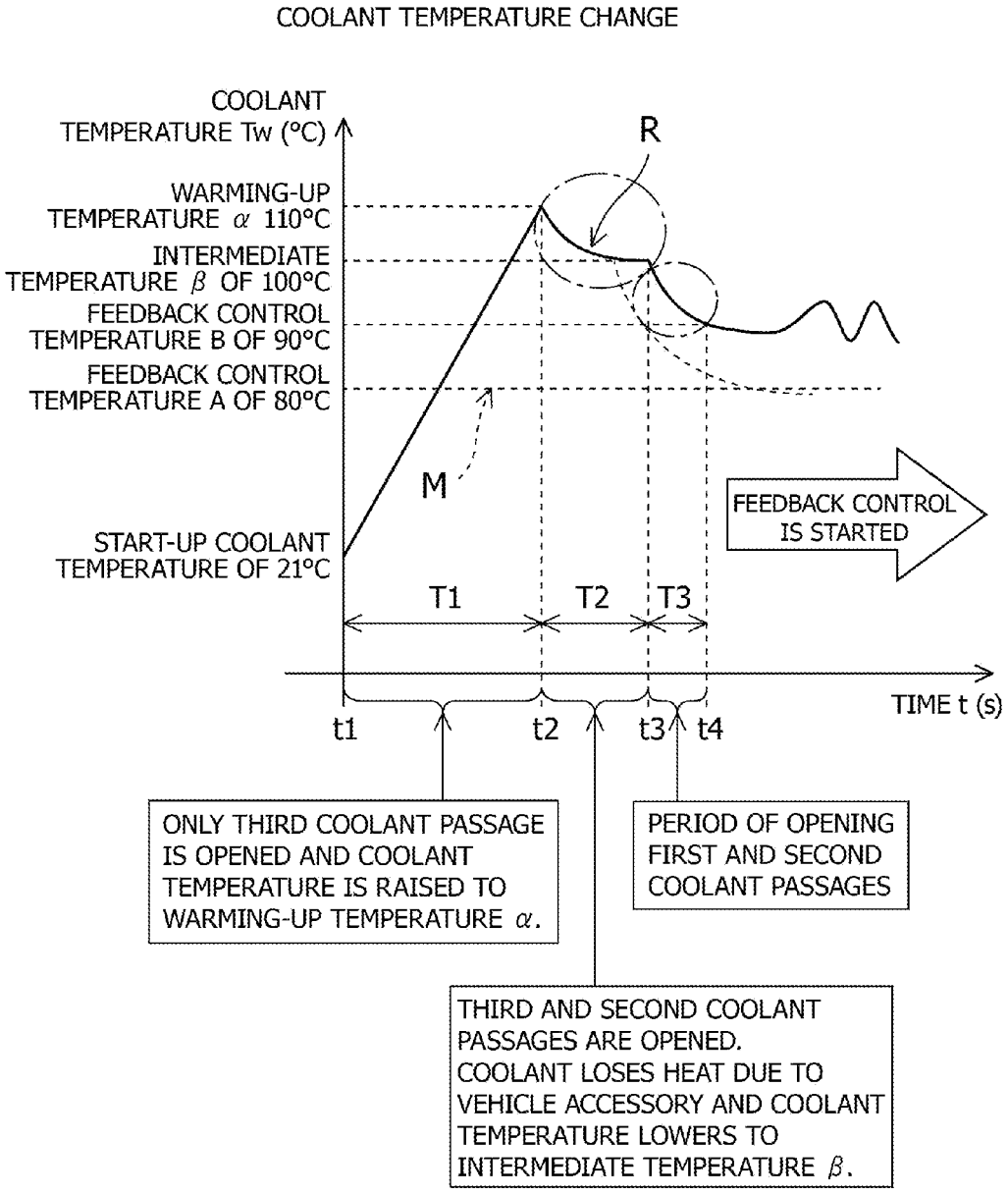
FIG. 15 is a graph showing changes of a coolant temperature. (Embodiment)

The coolant temperature (Tw) is changed as shown in FIG. 15. Specifically, from the start up of the internal combustion engine 2 (time t1) to the end of a first predetermined period T1 (time t2), only the third coolant passage 9 is opened, and the coolant temperature (Tw) is raised to the warming-up temperature (α).

After the coolant temperature (Tw) reaches the warming-up temperature (α), the third coolant passage 9 and the second coolant passage 8 are opened, so that the coolant loses the heat. The coolant temperature (Tw) lowers to the intermediate temperature (β) (time t3) after a second predetermined period T2 passes.

Since the coolant cooling device 5 and the vehicle accessory 7 are in the cold state before the coolant flows therein, the second predetermined period T2 exhibits a sharp gradient in the first coolant circulation cycle.

Thereafter, when the coolant cooling device 5 and the vehicle accessory 7 are warmed up gradually, the gradient becomes gentle. That is, fans of the coolant cooling device 5 and the heat exchanger maintain certain cooling capacities, as long as the rotational speeds of the fans provided are not changed. In other words, the cooling capacities are changed in a quadratic curve to prevent linear cooling.

When the coolant temperature (Tw) falls below the intermediate temperature (β), the accessory warming-up control is executed, so that the first coolant passage 6 and the second coolant passage 8 are opened. When a third predetermined period T3 passes (time t4) and the coolant temperature (Tw)

reaches the feedback control temperature (A or B) at the end of the predetermined period T3, feedback control is started.

The feedback control temperature includes the first feedback control temperature A and the second feedback control temperature B as described above. A broken line M is used for showing changes of the coolant temperature (Tw) in a case in which the target temperature (γ) is set at the feedback control temperature (A) upon detection of knocking.

For a case in which knocking is present, the intermediate temperature (β) is set at a lower temperature than in a case in which knocking is absent, so that the cooling control is started earlier.

Next, description is given of control according to this embodiment.

Figure 3:
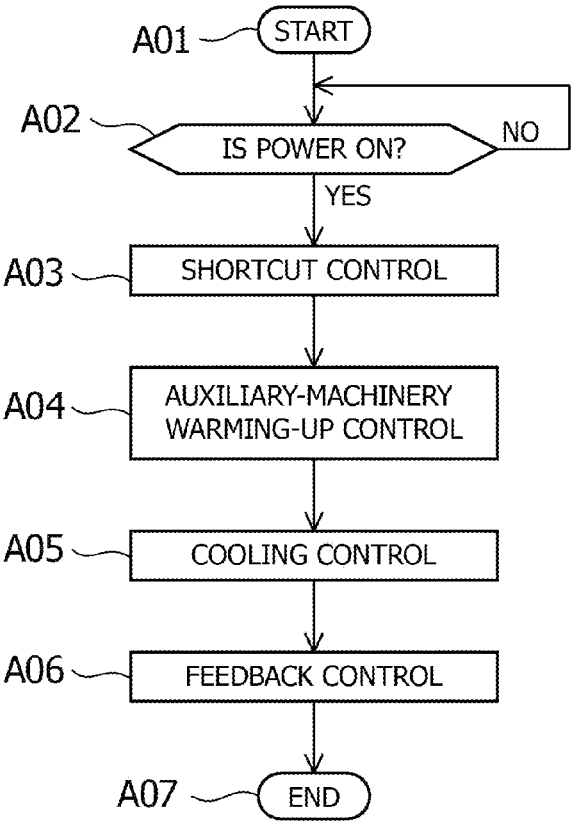
FIG. 3 is a main flowchart of control according to an embodiment. (Embodiment)

As shown in a main flowchart in FIG. 3, upon start of a program of the control device 14 (Step A01), it is first determined whether or not the power supply 16 is on, that is, whether or not a so-called accessory power supply is on (Step A02). If Step A02 results in NO, the determination is repeated.

If Step A02 results in YES, the shortcut control is performed (Step A03). The shortcut control in Step A03 will be described specifically with reference to a flowchart in FIG. 4 later.

The accessory warming-up control is performed after the shortcut control (Step A04). The accessory warming-up control in Step A04 will be descried specifically with reference to a flowchart in FIG. 5 later.

The cooling control is performed after the accessory warming-up control (Step A05). The cooling control in Step A05 will be described specifically with reference to a flowchart in FIG. 13 later.

The feedback control is performed after the cooling control (Step A06). The feedback control in Step A06 will be described specifically with reference to a flowchart in FIG. 14 later.

After the feedback control, the program is terminated (Step A07).

Figure 4:
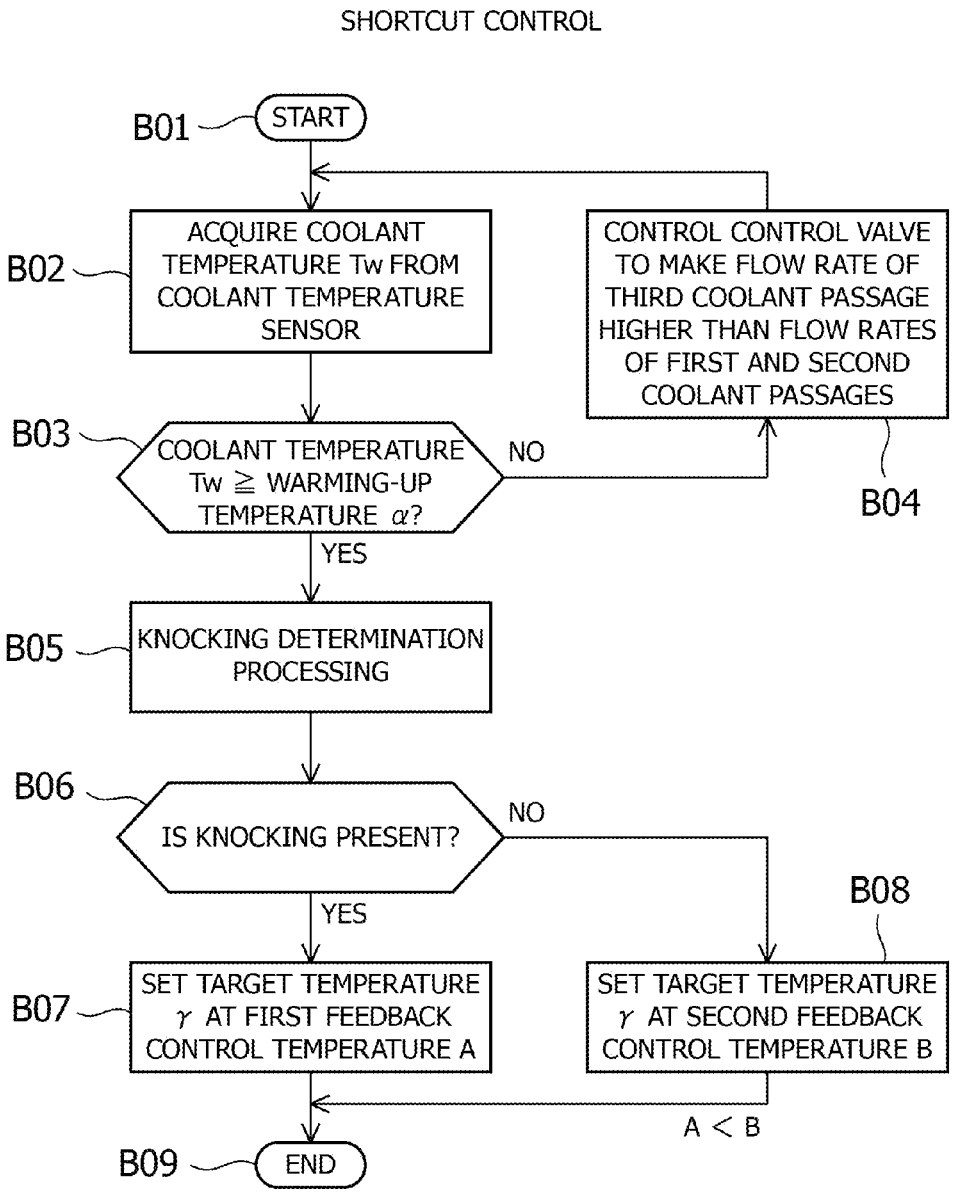
FIG. 4 is a flowchart of the shortcut control. (Embodiment)

The aforementioned shortcut control in Step A03 in FIG. 3 is performed in accordance with the flowchart in FIG. 4.

The shortcut control is performed when the temperature of the internal combustion engine 2 has not reached the preset warming-up temperature (α) and thus the internal combustion engine 2 is determined as being in the cold state. Accordingly, the control valve 10 is controlled (see FIG. 2A) to warm up the internal combustion engine 2 quickly in the following manner. Specifically, the coolant flow rate of the third coolant passage 9 is made higher than those of the first coolant passage 6 and the second coolant passage 8 by closing the first coolant passage 6 and the second coolant passage 8 or making smaller the areas of openings thereof. As shown in FIG. 4, upon start of a program of the shortcut control means 23 (Step B01), the coolant temperature (Tw) is firstly acquired from the coolant temperature sensor 19 (Step B02), and it is determined whether or not the coolant temperature (Tw) is equal to or higher than the preset warming-up temperature (α) (TV≥α) (Step B03). Note that in Step B03, the target temperature setting means 21 sets the target temperature (γ) of the coolant according to a factor such as the coolant temperature (Tw).

If Step B03 results in NO, the control valve 10 is controlled (see FIG. 2A), so that the coolant flow rate of the third coolant passage 9 is made higher than those of the first coolant passage 6 and the second coolant passage 8 (Step B04). This makes it possible to warm up the internal combustion engine 2 quickly.

After Step B04, the processing returns to Step B02.

If Step B03 results in YES, the knocking sensor 18 performs knocking determination processing (Step B05).

Then, it is determined whether or not knocking is present (Step B06). In Step B06, the knocking sensor 18 detects a generated current. If a vibration value of the internal combustion engine 2 is equal to or higher than a predetermined value, it is determined that knocking is present. The knocking determination is repeated in cycles. Once knocking is detected in the predetermined cycles, it is determined that knocking is present. If no knocking is detected in the predetermined cycles, it is determined that knocking is absent.

If Step B06 results in YES, the target temperature (γ) is set at the first feedback control temperature (A) (see FIG. 15) (Step B07).

On the other hand, if Step B06 results in NO, the target temperature (γ) is set at the second feedback control temperature (B) (Step B08).

After the processing in Step B07 or Step B08, the program is terminated (Step B09).

The aforementioned accessory warming-up control in Step A04 in FIG. 3 is performed in accordance with the flowchart in FIG. 5.

The accessory warming-up control is executed after the internal combustion engine 2 is warmed up according to the shortcut control, and thereby the vehicle accessory 7 is warmed up efficiently quickly. Specifically, the vehicle accessory 7 is warmed up while the control valve 10 (see FIG. 2B) is controlled in such a manner that the intermediate temperature (β) is calculated based on the warming-up temperature (α) and the target temperature (γ) and that the coolant flow rate of the second coolant passage 8 is increased until the coolant temperature (Tw) reaches the intermediate temperature (β).

As shown in FIG. 5, upon start of a program of the accessory warming-up control means 24 (Step C01), the intermediate temperature (β) is first calculated (Step C02). The intermediate temperature (β) is calculated in FIGS. 6 to 12, described later.

Then, the control valve 10 is controlled (see FIG. 2B) to increase the coolant flow rate of the second coolant passage 8 (Step C03). This makes it possible to warm up the vehicle accessory 7 quickly.

Thereafter, it is determined whether or not the coolant temperature Tw≤the intermediate temperature β (Step C04). If Step C04 results in NO, the processing is moved back to Step C02 to prohibit the cooling control.

On the other hand, if Step C04 results in YES, the program is terminated (Step C05).

To calculate the intermediate temperature (β) in aforementioned Step C02, there are the following first to fourth calculation methods.

Figure 6:
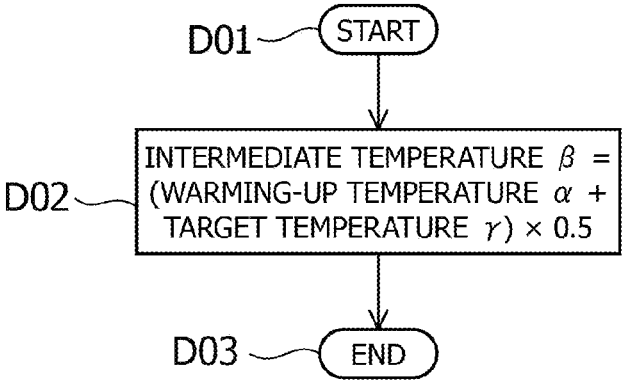
FIG. 6 is a flowchart of a first method for calculating an intermediate temperature (β). (Embodiment)

(1) In the first calculation method, upon start of the program (Step D01) as shown in FIG. 6, the intermediate temperature β is calculated in accordance with the following equation (Step D02).

Intermediate temperature β=(warming-up temperature α+target temperature γ)×0.5 (a proportion value: an average value)

Here, the intermediate temperature is multiplied by 0.5 which is the proportion value, but may be multiplied by 0.8, for example, to set the intermediate temperature (β) at a higher value, so that control is performed to open the first coolant passage 6 earlier. This is because when it is determined that knocking is present, quick cooling is required.

Then, the program is terminated (Step D03).

Figures 7, 8:
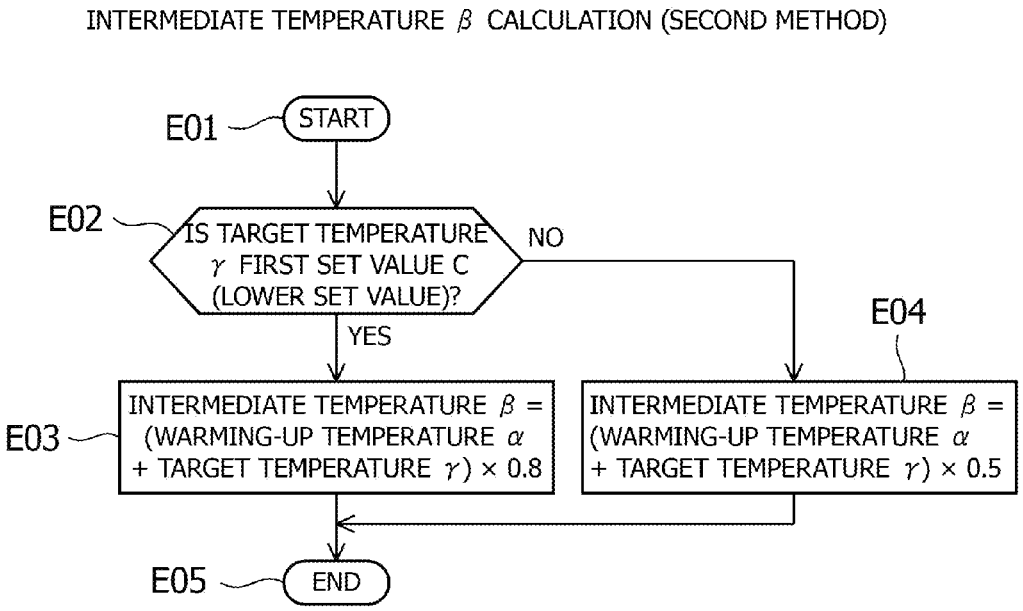
FIG. 7 is a flowchart of a second method for calculating the intermediate temperature (β). (Embodiment)
FIG. 8 is a table for explaining outside-air temperatures and proportion values in the calculation of the intermediate temperature (β) shown in FIG. 7. (Embodiment)

(2) In the second calculation method, the presence or absence of knocking is taken into consideration. As shown in FIGS. 7 and 8, if knocking is present, a first set value (C) is set, and the proportion value is set at 0.8. On the other hand, if knocking is absent, a second set value (D) is set, and the proportion value is set at 0.5. Here, the first set value (C) and the second set value (D) have a relation of C<D.

As shown in FIG. 7, upon start of the program (Step E01), it is determined whether or not the target temperature (γ) is the first set value (C: a lower set value) (Step E02).

If Step E02 results in YES, the intermediate temperature (β) is calculated in accordance with the following equation (Step E03).

Intermediate temperature β=(warming-up temperature α+target temperature γ)×0.8

On the other hand, if Step E02 results in NO, the intermediate temperature (β) is calculated in the following equation (Step E04).

Intermediate temperature β=(warming-up temperature α+target temperature γ)×0.5

After the processing in Step E03 or Step E04, the program is terminated (Step E05).

(3) In the third calculation method, as shown in FIGS. 9 and 10, the estimated cooling temperature is obtained based on the outside-air temperature detected from the outside-air temperature sensor 20.

For this reason, a table for deciding the estimated cooling temperature according to the outside-air temperature is set for FIG. 10.

As shown in FIG. 9, upon start of the program (Step F01), the outside-air temperature outputted from the outside-air temperature sensor 20 is detected. Then, the estimated cooling temperature is estimated based on the detected outside-air temperature (Step F02), as shown in FIG. 10.

Subsequently, the intermediate temperature (β) is calculated in accordance with the following equation (Step F03).

Intermediate temperature β=warming-up temperature α−the estimated cooling temperature Thereafter, the program is terminated (Step F04).

Figure 11:
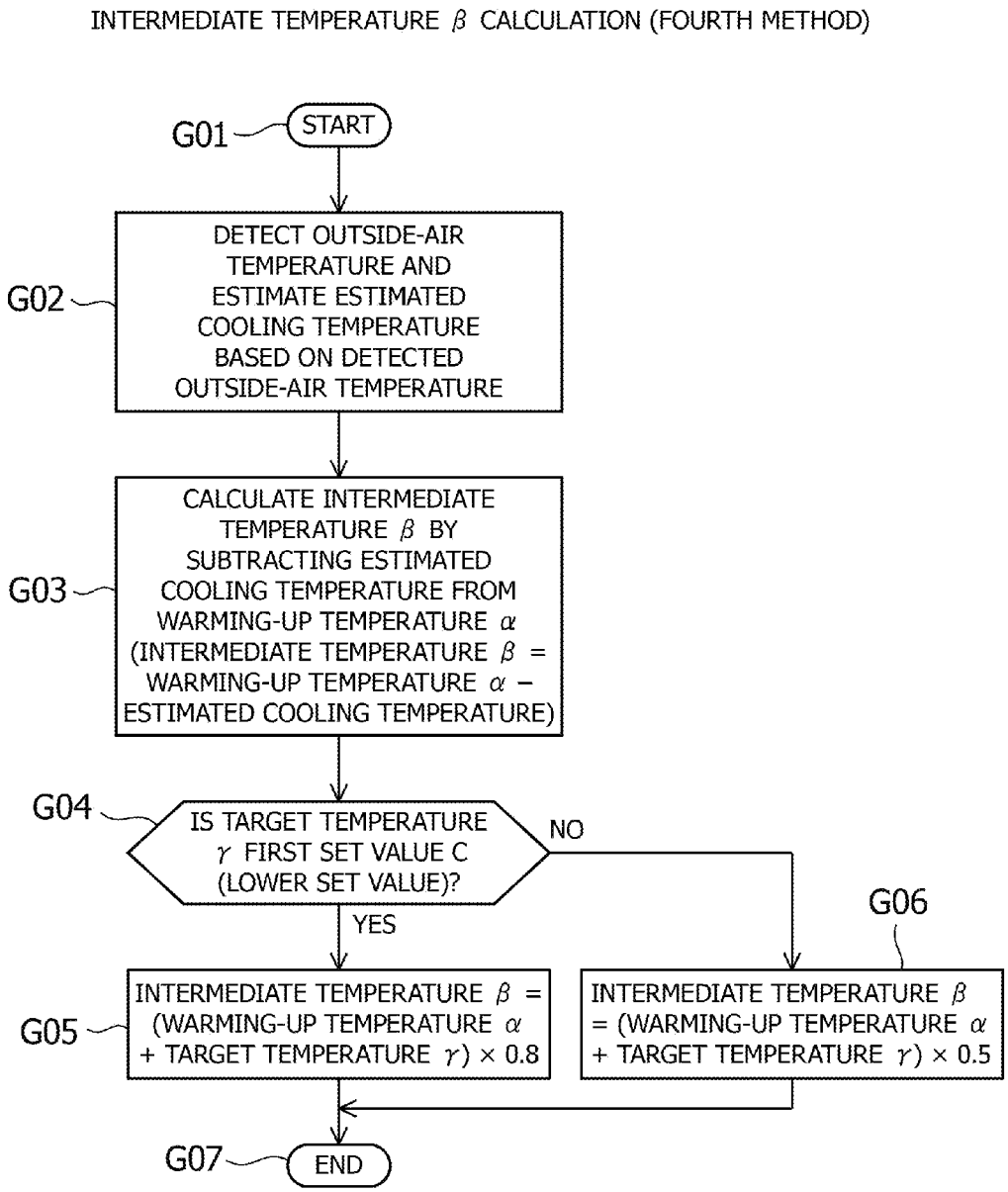
FIG. 11 is a flowchart of the third method for calculating the intermediate temperature (β). (Embodiment)

(4) In the fourth calculation method, the presence or absence of knocking is taken into consideration. As shown in FIGS. 11 and 12, if knocking is present, the first set value (C) is set, and the proportion value is set at 0.8. On the other hand, if knocking is absent, the second set value (D) is set, and the proportion value is set at 0.5. Here, there is a relation of the first set value C<the second set value D.

The estimated cooling temperature is obtained based on the outside-air temperature detected from the outside-air temperature sensor 20, as shown in FIG. 10 described above.

As shown in FIG. 11, upon start of the program (Step G01), the outside-air temperature outputted from the outside-air temperature sensor 20 is detected. Then, the estimated cooling temperature is estimated based on the detected outside air, as shown in FIG. 10 (Step G02).

Subsequently, the intermediate temperature (β) is calculated in accordance with the following equation (Step G03).

Intermediate temperature β=warming-up temperature α−estimated cooling temperature Thereafter, it is determined whether or not the target temperature (γ) is the first set value (C: the lower set value) (Step G04).

If Step G04 results in YES, the intermediate temperature (β) is calculated in accordance with the following equation (Step G05).

Intermediate temperature β=(warming-up temperature α+target temperature γ)×0.8

On the other hand, if Step G04 results in NO, the intermediate temperature (β) is calculated in accordance with the following equation (Step G06).

Intermediate temperature β=(warming-up temperature α+target temperature γ)×0.5

After the processing in Step G05 or Step G06, the program is terminated (Step G07).

The aforementioned cooling control in Step A05 in FIG. 3 is performed in accordance with the flowchart in FIG. 13.

The cooling control is executed after the vehicle accessory 7 is warmed up according to the aforementioned accessory warming-up control. After the vehicle accessory 7 is warmed up, the coolant temperature (Tw) is controlled to reach the target temperature (γ) quickly. Specifically, upon completion of the warming-up of the vehicle accessory 7, the control valve 10 is controlled (see FIG. 2C) in the following manner. The flow rate of the coolant flowing through the first coolant passage 6 is increased and the coolant cooling device (radiator) 5 is started to cool the coolant. At the same time, the third coolant passage 9 is closed to increase the hydraulic pressure in the first inlet-side coolant passage 6A, so that the flow rate per unit hour of the coolant flowing through the coolant cooling device 5 is increased. Furthermore, since the second coolant passage 8 is maintained opened, the temperature of the vehicle accessory 7 can be maintained constant even during the cooling control.

The cooling control is characterized in that the cooling control is performed after the accessory warming-up control. When the accessory warming-up control is completed, the temperature of the vehicle accessory 7 is a predetermined or higher temperature. Thus, the second coolant passage 8 is used as the shortcut passage like the third coolant passage 9.

Thereby, even though cooling by the coolant cooling device 5 is started, the coolant is less likely to be cooled rapidly. In addition, since the second coolant passage 8 is used, the temperature of the vehicle accessory 7 can be maintained stably.

As shown in FIG. 13, upon start of the program (Step H01), the control valve 10 is controlled (see FIG. 2C) in such a manner that the coolant flow rate of the first coolant passage 6 is increased and the third coolant passage 9 is closed (Step H02).

Then, it is determined whether or not the coolant temperature Tw≤the target temperature γ (Step H03). If Step H03 results in NO, the processing is moved back to Step H02. On the other hand, if Step H03 results in YES, the program is terminated (Step H04).

The aforementioned feedback control in Step A06 in FIG. 3 is performed in accordance with the flowchart in FIG. 14.

In the feedback control, the control valve 10 is controlled to maintain the coolant temperature (Tw) at the target temperature (γ). When the coolant temperature (Tw) is an abnormal overheat temperature (Ts) or higher, it is determined that the coolant is not cooled due to an anomaly occurring in the control valve 10, and thus the failsafe valve 26 is opened.

As shown in FIG. 14, upon start of the program (Step I01), it is determined whether or not the coolant temperature Tw>the target temperature γ (Step I02).

If Step I02 results in YES, the control valve 10 is controlled in such a manner that the first coolant passage 6 is closed at predetermined degrees (Step I03). In other words, the first coolant passage 6 is set to have a smaller area of the opening of the first coolant passage 6.

On the other hand, if Step I03 results in NO, the control valve 10 is controlled in such a manner that the first coolant passage 6 is opened at predetermined degrees (Step I04). In other words, the first coolant passage 6 is set to have a larger area of the opening of the first coolant passage 6.

After the processing in Step I03 or Step I04, it is determined whether or not the coolant temperature Tw≥the abnormal overheat temperature Ts (Step I05).

If Step I05 results in YES, the failsafe valve 26 is opened (Step I06), so that the processing is moved back to Step I02.

If Step I05 results in NO, it is determined whether or not the ignition switch 17 is off (Step I07).

If Step I07 results in NO, the processing is moved back to Step I02.

If Step I07 results in YES, the target temperature (γ) is reset (Step I08), and the program is terminated (Step I09).

Although the description has heretofore been given of the embodiment of the present invention, another description will be given while the configurations of the aforementioned embodiment are applied to claims.

First, in the invention according to claim 1, the first coolant passage 6, the second coolant passage 8, the third coolant passage 9, and the at least one control valve 10 are provided. The first coolant passage 6 allows the coolant discharged by the internal combustion engine 2 to flow in the circulated manner into the internal combustion engine 2 via the coolant cooling device 5. The second coolant passage 8 allows the coolant discharged by the internal combustion engine 2 to flow in the circulated manner into the internal combustion engine 2 via the vehicle accessory 7. The third coolant passage 9 has the lower cooling capacity than those of the first coolant passage 6 and the second coolant passage 8 and allows the coolant discharged by the internal combustion engine 2 to flow in the circulated manner into the internal combustion engine 2. The control valve 10 changes the flow rates of the coolant flowing through the first coolant passage 6, the second coolant passage 8, and the third coolant passage 9, respectively. In addition, the control device 14 includes the target temperature setting means 21, the feedback control means 22, and the shortcut control means 23. The target temperature setting means 21 sets the target temperature (γ) of the coolant according to the temperature state of the internal combustion engine 2. The feedback control means 22 controls the control valve 10 in such a manner that the temperature of the coolant is the target temperature (γ). The shortcut control means 23 controls the control valve 10 in such a manner that, when the internal combustion engine 2 is in a cold state, the target temperature setting means 21 sets as the target temperature (γ) a warming-up temperature (α) higher than a feedback control temperature (A or B) which is set during feedback control, and the shortcut control means controls the control valve in such a manner as to keep the coolant flow rate of the third coolant passage 9 higher than the coolant flow rates of the first coolant passage 6 and the second coolant passage 8 until the temperature of the coolant reaches the warming-up temperature (α).

Thereby, when the internal combustion engine 2 is in the cold state, the coolant flow rate of the third coolant passage 9 having the lower cooling capacity is increased to make it easier to maintain the coolant in a high-temperature state. With such a configuration, the target temperature setting means 21 can set the target temperature (γ) at the warming-up temperature (α) higher than the feedback control temperature (A or B) set during the feedback control, and thus can warm up the internal combustion engine 2 at earlier timing.

In the invention according to claim 2, the control device 14 includes the accessory warming-up control means 24 and the cooling control means 25. The accessory warming-up control means 24 warms up the vehicle accessory 7 by increasing the coolant flow rate of the second coolant passage 8 when the internal combustion engine 2 is in the warmed-up state. The cooling control means 25 cools the coolant by increasing the coolant flow rate of the first coolant passage 6 when the vehicle accessory 7 is warmed up.

With such a configuration, after the internal combustion engine 2 is in the warmed-up state, the coolant heated by the shortcut control means 23 is caused to flow into the vehicle accessory 7 before the flow rate of the coolant flowing through the coolant cooling device 5 is increased. Thus, the vehicle accessory 7 can be started to be warmed up at earlier timing than in the conventional technique. Moreover, since the coolant temperature (Tw) has reached the warming-up temperature ( ) at this time, the vehicle accessory 7 can be warmed up quickly using the high coolant temperature (Tw). Furthermore, when the vehicle accessory 7 is warmed up, the coolant has lost the heat due to the vehicle accessory 7, and thus the coolant temperature (Tw) is close to the feedback control temperature (A or B). Accordingly, if the control by the cooling control means 25 is started after the vehicle accessory 7 is warmed up, the feedback control can be started in a short time.

In the invention according to claim 3, the accessory warming-up control means 24 controls the control valve 10 in such a manner that the third coolant passage 9 is maintained opened.

With such a configuration, when the accessory warming-up control means 24 of the internal combustion engine 2 according to claim 2 warms up the vehicle accessory 7 by increasing the coolant flow rate of the second coolant passage 8, the third coolant passage 9 is maintained opened. Thus, some of the coolant to flow into the internal combustion engine 2 flows in the circulated manner into the internal combustion engine 2 via the third coolant passage 9. Therefore, even though the coolant consumes the heat for warming up the vehicle accessory 7, the temperature of the third coolant passage 9 is raised simultaneously, so that the high-temperature coolant is always supplied to the vehicle accessory 7. Thus, the vehicle accessory 7 can be warmed up quickly. Here, when the outside-air temperature is low, flow of the coolant through the vehicle accessory 7 might cause the coolant temperature (Tw) to be lower than the feedback control temperature (A or B). In this respect, the configuration is also effective to prevent rapid cooling.

In the invention according to claim 4, the accessory warming-up control means 24 prohibits the cooling control until the coolant temperature (Tw) reaches the intermediate temperature (β) set at the value between the warming-up temperature (α) and the feedback control temperature (A or B).

Generally, the cooling control is executed immediately after the accessory warming-up control, and then cooling by the coolant cooling device 5 is started before the vehicle accessory 7 is warmed up. This might cause the rapid cooling, because the coolant loses heat at this time due to both the vehicle accessory 7 and the coolant cooling device 5. Hence, the configuration described above makes it possible to maintain, until the coolant temperature (Tw) reaches the intermediate temperature (β), the warming-up of the vehicle accessory 7, that is, a state where the coolant is cooled by the vehicle accessory 7 and thus to prevent the rapid cooling.

In the invention according to claim 5, the accessory warming-up control means 24 calculates the intermediate temperature (β) by subtracting the estimated cooling temperature estimated based on the outside-air temperature from the warming-up temperature (α).

Such a configuration makes it possible to keep the control over the vehicle accessory 7 until the vehicle accessory 7 is in the warmed-up state and thus to warm up the vehicle accessory 7 quickly. In addition, when the cooling control is executed after the control of the vehicle accessory 7, the temperature of the vehicle accessory 7 is prevented from being lowered.

In the invention according to claim 6, the internal combustion engine 2 is provided with the knocking sensor 18 configured to detect abnormal combustion in the internal combustion engine 2. In addition, when the knocking sensor 18 detects abnormal combustion, the accessory warming-up control means 24 sets the intermediate temperature ( ) at a temperature higher than in a case in which the knocking sensor 18 does not detect abnormal combustion.

Generally, when having abnormal combustion, the internal combustion engine 2 needs to be cooled quickly to solve the abnormal combustion. Hence, with the configuration as described above in which the intermediate temperature ( ) is set at the higher temperature when the abnormal combustion is detected, the cooling control can be started at earlier timing to achieve the quick cooling.

In the invention according to claim 7, the cooling control means 25 controls the control valve 10 in such a manner that when the vehicle accessory 7 is in the warmed-up state, at least one of the coolant passages different from the first coolant passage 6 is maintained opened, and the coolant flow rate of the first coolant passage 6 is increased.

Generally, the coolant cooling device 5 is used to cool the coolant flowing through the first coolant passage 6. However, the coolant cooling device 5 itself is in the cold state, the coolant is cooled rapidly at the time of initial influx of the coolant, and thus might be supercooled. Hence, with the configuration as described above, the different coolant passage is maintained opened at the time of the initial influx into the coolant cooling device 5. Thus, the configuration makes it possible to make the rapid cooling slower and thus to prevent the supercooling. Specifically, the cooling control means 25 prevents the supercooling of the coolant in the following manner. The control valve 10 is controlled in such a manner that the third coolant passage 9 having the low cooling capacity and the second coolant passage 8 used for the warming-up are used as the shortcut passages. Thereby, some of the coolant is caused not to be cooled to flow into the internal combustion engine 2.

In the invention according to claim 8, the different coolant passage according the claim 7 described above is the second coolant passage 8.

Such a configuration makes it possible to maintain constant the temperature of the vehicle accessory 7 during the control, and thus is preferable in running a vehicle.

In the invention according to claim 9, the cooling control means 25 controls the control valve 10 in such a manner that when the vehicle accessory 7 is in the warmed-up state, at least one of the coolant passages, except the different coolant passage maintained opened, is closed.

With such a configuration, at least one of the coolant passages, except the different coolant passage, is closed at the initial influx into the coolant cooling device 5, and thereby the pressure in the first coolant passage 6 is increased to increase the flow rate of the coolant. Thus, the flow rate per hour of the coolant passing through the coolant cooling device 5 is increased. For this reason, heat of the coolant is increased and then provided for the coolant cooling device 5, so that the cold state is overcome quickly.

In the invention according to claim 10, the coolant passage except the different coolant passage according to claim 9 described above is the third coolant passage 9.

With such a configuration, closing the third coolant passage 9 makes it possible to enhance the efficiency of the cooling control.

It should be noted that the cooling apparatus 4 may be configured as follows in the present invention.

Figure 16:
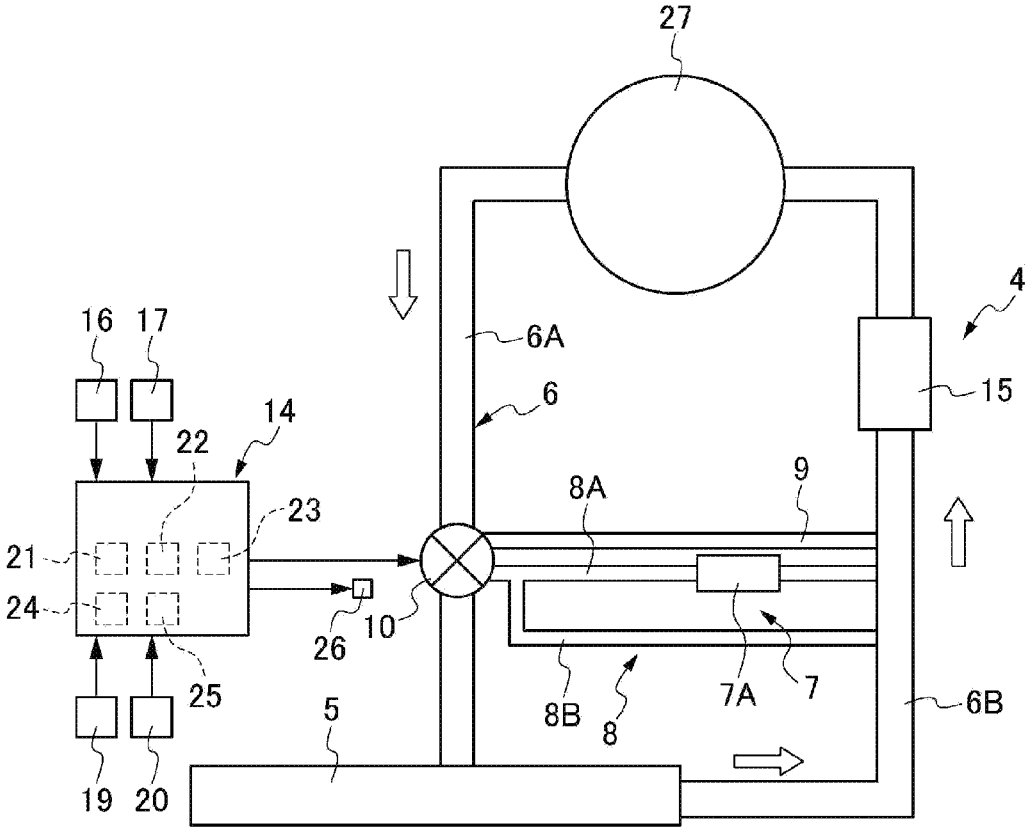
FIG. 16 is a system configuration diagram of a cooling apparatus for cooling an electrical motor. (Modification)

For example, in a modification, an electric motor 27 is cooled as the power source instead of the internal combustion engine 2 in the cooling apparatus 4 according to the aforementioned embodiment so that the cooling apparatus 4 can be used for an electrically driven vehicle such as a hybrid vehicle or an electric vehicle, as shown in FIG. 16. Specifically, a hole portion is formed in a resin motor case covering a coil which is a heat-producing body in the electric motor 27. A metal pipe is put through the hole portion to be used as a coolant passage. Alternatively, a coolant passage may be formed integrally with a metal motor case. Meanwhile, an electric vehicle does not include the internal combustion engine 2 and thus does not have a throttle body. For this reason, only the first vehicle accessory 7A is arranged as the vehicle accessory 7 on the second main coolant passage 8A.

As described above, the configuration in which the electric motor is mounted on the vehicle can also provide operations and advantageous effects similar to those in the aforementioned Embodiment.

Moreover, the following configuration may be employed. Specifically, to detect knocking occurrence timing with higher accuracy, it is determined that control in which anti-knocking means retards ignition timing is started upon detection of knocking by the knocking sensor. Then, the target temperature of the control valve is changed from 110° C. to 90° C., for example.

INDUSTRIAL APPLICABILITY

The cooling apparatus according to the present invention is applicable to various internal combustion engines.

REFERENCE SIGNS LIST

2 internal combustion engine
4 cooling apparatus
5 coolant cooling device
6 first coolant passage
7 vehicle accessory
8 second coolant passage
9 third coolant passage
10 control valve
14 control device
15 water pump
16 power supply
17 ignition switch
18 knocking sensor
19 coolant temperature sensor
20 outside-air temperature sensor
21 target temperature setting means
22 feedback control means
23 shortcut control means
24 accessory warming-up control means
25 cooling control means

The invention claimed is:

1. A cooling apparatus of an internal combustion engine for a vehicle, comprising:

a coolant cooling device for cooling a coolant used for cooling the internal combustion engine;

a control device for controlling a coolant passage according to a temperature state of the internal combustion engine;

a first coolant passage which allows the coolant discharged from the internal combustion engine to flow in a circulated manner into the internal combustion engine via the coolant cooling device;

a second coolant passage which allows the coolant discharged from the internal combustion engine to flow in a circulated manner into the internal combustion engine via a vehicle accessory;

a third coolant passage which allows the coolant discharged from the internal combustion engine to flow in the circulated manner into the internal combustion engine, the third coolant passage having a cooling capacity lower than those of the first coolant passage and the second coolant passage; and at least one control valve by which coolant flow rates of the first coolant passage, the second coolant passage, and the third coolant passage are changed, wherein the control device includes:

feedback control means for controlling the at least one control valve in such a manner that a temperature of the coolant is maintained at a feedback control temperature;

shortcut control means for controlling the at least one control valve in such a manner, when the internal combustion engine is in a cold state, as to keep the coolant flow rate of the third coolant passage higher than the coolant flow rates of the first coolant passage and the second coolant passage until the temperature of the coolant reaches a warming-up temperature higher than the feedback control temperature;

accessory warming-up control means for warming up the vehicle accessory by increasing the coolant flow rate of the second coolant passage when the temperature of the coolant reaches the warming-up temperature, and by prohibiting the cooling of the coolant until the temperature of the coolant reaches an intermediate temperature set between the warming-up temperature and the feedback control temperature; and cooling control means for cooling the coolant by increasing the coolant flow rate of the first coolant passage when the temperature of the coolant reaches the intermediate temperature, until the temperature of the coolant reaches the feedback control temperature and the controlling of the feedback control means starts, wherein the accessory warming-up control means calculates the intermediate temperature by subtracting an estimated cooling temperature estimated based on an outside-air temperature from the warming-up temperature.

2. A cooling apparatus of an internal combustion engine for a vehicle, comprising:

a coolant cooling device for cooling a coolant used for cooling the internal combustion engine;

a control device for controlling a coolant passage according to a temperature state of the internal combustion engine;

a first coolant passage which allows the coolant discharged from the internal combustion engine to flow in a circulated manner into the internal combustion engine via the coolant cooling device;

a second coolant passage which allows the coolant discharged from the internal combustion engine to flow in a circulated manner into the internal combustion engine via a vehicle accessory;

a third coolant passage which allows the coolant discharged from the internal combustion engine to flow in the circulated manner into the internal combustion engine, the third coolant passage having a cooling capacity lower than those of the first coolant passage and the second coolant passage;

at least one control valve by which coolant flow rates of the first coolant passage, the second coolant passage, and the third coolant passage are changed; and a knocking sensor which detects abnormal combustion in the internal combustion engine, wherein the control device includes:

feedback control means for controlling the at least one control valve in such a manner that a temperature of the coolant is maintained at a feedback control temperature;

shortcut control means for controlling the at least one control valve in such a manner, when the internal combustion engine is in a cold state, as to keep the coolant flow rate of the third coolant passage higher than the coolant flow rates of the first coolant passage and the second coolant passage until the temperature of the coolant reaches a warming-up temperature higher than the feedback control temperature;

accessory warming-up control means for warming up the vehicle accessory by increasing the coolant flow rate of the second coolant passage when the temperature of the coolant reaches the warming-up temperature, and by prohibiting the cooling of the coolant until the temperature of the coolant reaches an intermediate temperature set between the warming-up temperature and the feedback control temperature; and cooling control means for cooling the coolant by increasing the coolant flow rate of the first coolant passage when the temperature of the coolant reaches the intermediate temperature, until the temperature of the coolant reaches the feedback control temperature and the controlling of the feedback control means starts, wherein, when the knocking sensor detects abnormal combustion, the accessory warming-up control means sets the intermediate temperature at a temperature higher than in a case in which the knocking sensor does not detect the abnormal combustion.

3. A cooling apparatus of an internal combustion engine for a vehicle, comprising:

a coolant cooling device for cooling a coolant used for cooling the internal combustion engine;

a control device for controlling a coolant passage according to a temperature state of the internal combustion engine;

a first coolant passage which allows the coolant discharged from the internal combustion engine to flow in a circulated manner into the internal combustion engine via the coolant cooling device;

a second coolant passage which allows the coolant discharged from the internal combustion engine to flow in a circulated manner into the internal combustion engine via a vehicle accessory;

a third coolant passage which allows the coolant discharged from the internal combustion engine to flow in the circulated manner into the internal combustion engine, the third coolant passage having a cooling capacity lower than those of the first coolant passage and the second coolant passage; and at least one control valve by which coolant flow rates of the first coolant passage, the second coolant passage, and the third coolant passage are changed, wherein the control device is configured to perform:

a feedback control for controlling the at least one control valve in such a manner that a temperature of the coolant is maintained at a feedback control temperature;

a shortcut control for controlling the at least one control valve in such a manner, when the internal combustion engine is in a cold state, as to keep the coolant flow rate of the third coolant passage higher than the coolant flow rates of the first coolant passage and the second coolant passage until the temperature of the coolant reaches a warming-up temperature higher than the feedback control temperature;

an accessory warming-up control for warming up the vehicle accessory by increasing the coolant flow rate of the second coolant passage when the temperature of the coolant reaches the warming-up temperature, and by prohibiting the cooling of the coolant until the temperature of the coolant reaches an intermediate temperature set between the warming-up temperature and the feedback control temperature; and a cooling control for cooling the coolant by increasing the coolant flow rate of the first coolant passage when the temperature of the coolant reaches the intermediate temperature, until the temperature of the coolant reaches the feedback control temperature and the feedback control starts, wherein the intermediate temperature is calculated in the accessory warming-up control by subtracting an estimated cooling temperature estimated based on an outside-air temperature from the warming-up temperature.

4. A cooling apparatus of an internal combustion engine for a vehicle, comprising:

a coolant cooling device for cooling a coolant used for cooling the internal combustion engine;

a control device for controlling a coolant passage according to a temperature state of the internal combustion engine;

a first coolant passage which allows the coolant discharged from the internal combustion engine to flow in a circulated manner into the internal combustion engine via the coolant cooling device;

a second coolant passage which allows the coolant discharged from the internal combustion engine to flow in a circulated manner into the internal combustion engine via a vehicle accessory;

a third coolant passage which allows the coolant discharged from the internal combustion engine to flow in the circulated manner into the internal combustion engine, the third coolant passage having a cooling capacity lower than those of the first coolant passage and the second coolant passage; and at least one control valve by which coolant flow rates of the first coolant passage, the second coolant passage, and the third coolant passage are changed, a knocking sensor which detects abnormal combustion in the internal combustion engine, wherein the control device is configured to perform:

a feedback control for controlling the at least one control valve in such a manner that a temperature of the coolant is maintained at a feedback control temperature;

a shortcut control for controlling the at least one control valve in such a manner, when the internal combustion engine is in a cold state, as to keep the coolant flow rate of the third coolant passage higher than the coolant flow rates of the first coolant passage and the second coolant passage until the temperature of the coolant reaches a warming-up temperature higher than the feedback control temperature;

an accessory warming-up control for warming up the vehicle accessory by increasing the coolant flow rate of the second coolant passage when the temperature of the coolant reaches the warming-up temperature, and by prohibiting the cooling of the coolant until the temperature of the coolant reaches an intermediate temperature set between the warming-up temperature and the feedback control temperature; and a cooling control for cooling the coolant by increasing the coolant flow rate of the first coolant passage when the temperature of the coolant reaches the intermediate temperature, until the temperature of the coolant reaches the feedback control temperature and the feedback control starts, wherein, when the knocking sensor detects abnormal combustion in the accessory warming-up control, the intermediate temperature is set at a temperature higher than in a case in which the knocking sensor does not detect the abnormal combustion.

* * * * *